US005562035A

United States Patent [19]

Pollich et al.

[11] Patent Number: 5,562,035

[45] Date of Patent: Oct. 8, 1996

[54] ADJUSTING DEVICE WITH A PNEUMATIC CYLINDER IN A PRINTING PRESS

[75] Inventors: Gerhard Pollich, Heidelberg; Lothar Stadler, Eppelheim; Hans-Jürgen Bernau, Ladenburg, all of Germany

[73] Assignee: Heidelberger Druckmaschinen AG, Heidelberg, Germany

[21] Appl. No.: 535,709

[22] Filed: Sep. 28, 1995

[30] Foreign Application Priority Data

Sep. 28, 1994 [DE] Germany ..... 44 34 623.9

[51] Int. Cl.[6] ..... B41F 13/24

[52] U.S. Cl. ..... 101/232; 101/410; 91/459

[58] Field of Search ..... 101/231, 232, 101/408, 409, 410, 411, 415.1; 91/459, 275

[56] References Cited

U.S. PATENT DOCUMENTS

| | | | |
|---|---|---|---|
| 4,882,988 | 11/1989 | Yamaguchi | 101/232 |
| 4,919,015 | 4/1990 | Richeson et al. | 91/459 |
| 5,074,208 | 12/1991 | Filsinger | 101/232 |
| 5,390,601 | 2/1995 | Fricue et al. | 101/410 |
| 5,427,012 | 6/1995 | Frigon et al. | 91/459 |

FOREIGN PATENT DOCUMENTS

| | | |
|---|---|---|
| 1751206 | 6/1971 | Germany . |
| 2005144 | 9/1971 | Germany . |
| 4118659 | 12/1992 | Germany . |

*Primary Examiner*—Eugene H. Eickholt
*Attorney, Agent, or Firm*—Laurence A. Greenberg

[57] ABSTRACT

An adjusting device has a pneumatically operating piston-cylinder unit pressurizable in an operating function thereof for actuating adjusting elements in a printing press. The piston-cylinder unit includes a cylinder housing formed with a cylinder chamber, a piston displaceable in the cylinder chamber, and an electromagnet for applying an activated holding force to the piston, the piston being subjectible pneumatically to a prepressurizing force in the cylinder chamber opposite to and less than the activated holding force.

7 Claims, 2 Drawing Sheets

ADJUSTING DEVICE WITH A PNEUMATIC CYLINDER IN A PRINTING PRESS

BACKGROUND OF THE INVENTION

1. Field of the Invention

The invention relates to an adjusting device with a pneumatic cylinder in a printing press and, more particularly, a pneumatically operating piston-cylinder unit for actuating final control or adjusting elements in a printing press, the piston-cylinder unit, hereinafter also referred to as a pneumatic cylinder, being pressurized in the operating function thereof by partial action thereon and being lockable in the pressurized setting. The invention relates, in particular, to such a device for use in an arrangement for preventing the entry or in-feed of a mis-fed sheet or multiple sheets into a printing press.

The published German Patent Document DE 41 18 659 A 1 discloses an arrangement for actuating adjusting elements for starting and stopping printing in a sheet-fed printing press or for blocking the feeding of sheets, wherein latches which are able to be affected by electromagnets and by spring force are operatively associated with a lever which is pivotable about a fixed pivot point and connected to a drive member, and a piston-cylinder unit which is able to be acted upon hydraulically or possibly pneumatically, as well, for swivelling the lever after it has been unlocked, is provided, the piston-cylinder unit serving to swivel the lever, if mis-fed sheets are detected after the lever has been unlocked by the electromagnet, out of a relaxed or non-stressed zero or neutral position into a blocking position, wherein sheet grippers, for example, are blocked in the open position. For small-format pneumatic cylinders, the force is too low to re-open closed or partly-open grippers again, because they have to be quite small in order to travel the distance prescribed by the opening, within the shortest possible time. For electromagnets, the excitation time is very long, and the least force is available in the initial phase of the motion. The stroke of an electromagnet, under the prescribed conditions, is therefore limited. The physical conditions of a small pneumatic cylinder and of electromagnets have a particularly deleterious effect in high-speed printing presses.

SUMMARY OF THE INVENTION

It is accordingly an object of the invention to provide an improved adjusting device with a pneumatic cylinder in a printing press having the foregoing general characteristics which exhibits extremely short switching times with adjusting forces having adequate strength and switching distances of adequate length.

With the foregoing and other objects in view, there is provided, in accordance with the invention, an adjusting device with a pneumatically operating piston-cylinder unit pressurizable in an operating function thereof for actuating adjusting elements in a printing press, the piston-cylinder unit comprising a cylinder housing formed with a cylinder chamber, a piston displaceable in the cylinder chamber, and an electromagnet for applying an activated holding force to the piston, the piston being subjectible pneumatically to a prepressurizing force in the cylinder chamber opposite to and less than the activated holding force.

In accordance with another feature of the invention, the cylinder chamber has an air inlet communicating with an air supply more highly pressurized in a volume greater than that within the cylinder chamber, the air inlet being openable for admitting air with a maximum pressure drop into the cylinder chamber without having to refill any of the air.

In accordance with another aspect of the invention, there is provided an adjusting device for switching off or arresting travel of a mis-fed sheet in a feeder of a sheet-fed printing press having a pneumatically operational piston-cylinder unit secured to a press frame and being operatively engageable with a control lever for sheet grippers, the piston-cylinder unit comprising a cylinder housing fixed to the press frame and formed with a cylinder chamber, a piston displaceable in an axial direction thereof in the cylinder chamber, and an electromagnet for applying a holding force to the piston, the piston being subjectible pneumatically in the axial direction to a prepressurizing force in the cylinder chamber opposite to and less than the holding force.

In accordance with a further feature of the invention, the adjusting device includes a piston rod connected to the piston and having an end extending out of the cylinder housing, an iron armature plate connected to the piston end outside the cylinder chamber, and an electromagnet secured to the cylinder housing opposite the armature plate, the electromagnet and the armature plate, respectively, being formed with mutually parallel contact surfaces.

In accordance with an added feature of the invention, the iron armature plate is movably disposed in an interior chamber formed in the cylinder housing, the interior chamber having an end face located opposite the piston of the piston-cylinder unit which is formed by the electromagnet.

In accordance with an additional feature of the invention, the adjusting device includes a piston rod connected to the piston and having a free end thereof extending out of the cylinder housing, an abutment fixed to the cylinder housing, an adjusting lever swivellable about an axis and spring-biased in a direction of movement thereof against the abutment, the abutment and the adjusting lever being formed with respective support surfaces converging wedgelike towards one another in a direction of operation of the piston, the free end of the piston extending out of the cylinder housing engaging between the support surfaces.

In accordance with a concomitant feature of the invention, the adjusting lever is a bell crank having one arm whereon the support surface of the adjusting lever is formed, and including at least one roller supported with a roller bearing on the free end of the piston rod outside the cylinder housing, the roller having a peripheral surface with which the roller engages the support surface of the fixed abutment and the support surface on the one arm of the bell crank.

In a device constructed in this manner, in accordance with the invention, the piston of the piston-cylinder unit can be prestressed or pressurized in advance by being acted upon with compressed air and can be held in this prestressed position by the electromagnet. If mis-fed sheets are detected, the electromagnet becomes voltageless. Due to the air prepressurized or prestressed in the cylinder chamber and and due to the air flowing-in thereafter, the adjusting motion is executed immediately, and entry of the mis-fed sheet into the printing press is thus prevented. Compared with conventional devices, economies in switching times, control time for the air control valve, and the filling time of the cylinder are realized with the device according to the invention.

To attain the strongest possible adjusting forces and short adjusting paths, as noted hereinbefore, in a further concept of the invention, the piston rod which extends out of the cylinder housing has a free end which is received between two surfaces, respectively, of an abutment fixed to the cylinder housing and of an adjusting lever swivellable or pivotable about an axis and urged by a spring in the direction of the motion thereof against the abutment fixed to the housing, and the support faces extend convergingly towards one another in a wedgelike manner in the direction of operation of the piston of the piston-cylinder unit. The free end of the piston rod thus presses into the wedge-shaped gap, creating a transverse force which becomes many times stronger than the piston force. The transverse force advantageously acts upon one arm of the gripper lever. It is sufficiently strong to rotate this arm counter to the springs of the gripper lever and to reopen the grippers. Preferably on the free end of the piston rod outside the cylinder housing, at least one roller is supported with a roller bearing and engages by the peripheral or circumferential surface thereof with the support surface of the fixed abutment and the support surface of one arm of a bell crank constituting the adjusting lever. Frictional forces are thereby avoided to the greatest possible extent, and low-noise operation is achieved.

Other features which are considered as characteristic for the invention are set forth in the appended claims. Although the invention is illustrated and described herein as embodied in an adjusting device with a pneumatic cylinder in a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENTS

Figure 1:
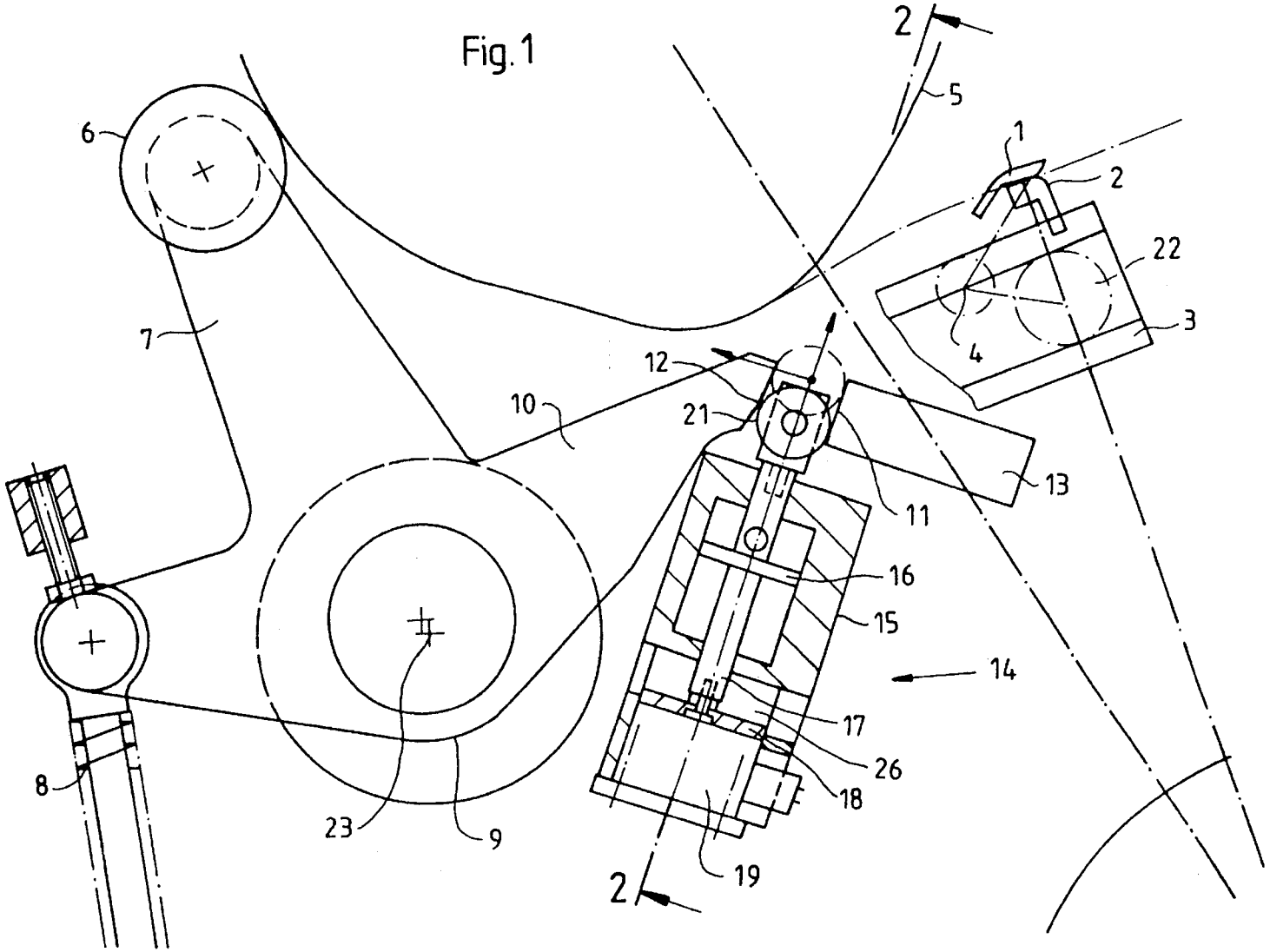
FIG. 1 is a diagrammatic side elevational view, partly in section, of a device for opening grippers on a pregripper for sheet feeding in a sheet-fed printing press, according to the invention.

Referring now to the figures of the drawing, there is shown, therein, at a reduced scale, on the right-hand side of FIG. 1, a sheet gripper 1, which is able to be affected or influenced by the adjusting device of the invention, together with a gripper pad 2 of a gripper system of a pregripper for sheet feeding in a sheet-fed printing press. A plurality of sheet grippers 1 with a gripper pad 2, disposed side-by-side crosswise to the sheet feeding direction, form the gripper system of the pregripper which, with the gripper system thereof, grasps a respective sheet by a leading edge thereof and feeds the sheet to the printing press by swivelling the pregripper about a swivel axis of a pregripper lever. The pregripper per se is not shown in the drawing, in the interest of clarity and simplicity. The sheet gripper 1 is suitably mounted so as to swivel about an axis 4 on the pregripper lever.

A cam disk 5 controls the opening and closing motion of the sheet gripper 1 about the axis 4 by means of a cam roller 6, which rests on the cam disk 5 and is supported on an arm 7 of an angle lever or bell crank 9, which is connected to a shaft 23 by an indexing segment 3 and is biased by spring force of a spring 8, so that the cam roller 6 is pressed by the spring force against the circumference of the cam disk 5 and, via the indexing segment 3, presses the roller 22 downwardly, as viewed in FIG. 1.

Figure 2:
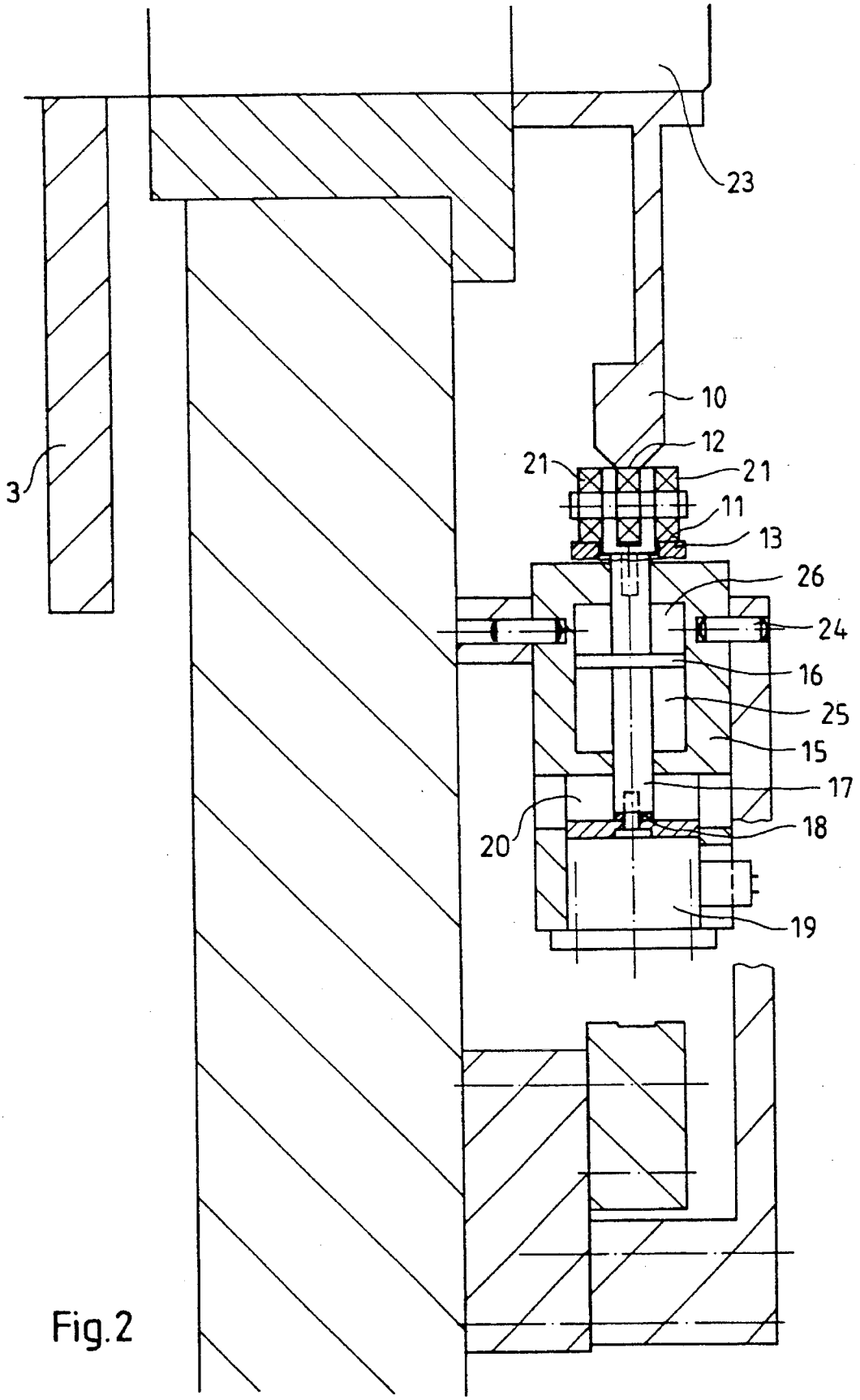
FIG. 2 is a cross-sectional view of FIG. 1, taken along the line 2—2 in the direction of the arrows.

The other arm 10 of the bell crank 9 is formed with a support surface 12, which extends wedgelike to a support surface 11 formed on a fixed abutment The adjusting device includes a piston-cylinder unit 14 which can be acted upon pneumatically, and has a cylinder housing 15 which is secured to the press frame yet is anchored so as to be rotatable about a bolt 24 (note FIG. 2). A piston 16 is movable in the cylinder chamber and connected by a piston rod 17 to an iron armature plate 18 which cooperates with an electromagnet 19 having a current supply which is switchable on and off. The armature plate 18 is movable in an interior chamber 20 formed in the cylinder housing 15, wherein an electromagnet 19 is also received, so that both the armature plate 18 and the electromagnet 19 are suitably protected.

An opposite free end of the piston rod 17 extends out of the cylinder housing 15, and at least one roller 21 is freely rotatably supported with a roller bearing thereon; the circumference of this roller 21 presses, on the one hand, against the support surface 11 on the fixed abutment 13 and, on the other hand, against the support surface 12 on the free end of the arm 10 of the bell crank 9. In operating position, the electromagnet 19 has a voltage applied thereto, so that it attracts the armature plate 18 and locks it with a predeterminable holding force. As a result, the piston 16 in the cylinder chamber 25 can be prestressed or preloaded by an application of compressed air to approximately the holding force of the magnet 19. A higher pressure of the air prevails in the connecting line, however. In this setting, the adjusting device does not hinder or impair the opening and closing motions of the sheet gripper 1 by the cam disk 5 via the cam roller 6. The instant the sensors detect a mis-fed sheet situation, the electromagnet 19 is switched to a no-voltage condition, and the air in the cylinder chamber 25 is replenished via an open valve so as to act upon the piston 16. The roller 21, or a plurality of rollers 21 supported side-by-side, are thereby pressed between the support surfaces 11 and 12 of the fixed abutment 13 and of the arm 10 on the bell crank 9, respectively, so that the sheet gripper 1 is opened again counter to the action of the spring 8. The higher prestressing or prepressurizing of the air upstream of the inlet into the cylinder chamber 25 is advantageous in such a process, because the filling of the cylinder chamber takes place after the opening of the inflow valve and with a maximum pressure drop, without air replenishment or refilling.

By activating the electromagnet 19 and filling the cylinder chamber 26 with air, the adjusting device returns to the starting position thereof. The function of the device according to the invention is independent of the thickness of the sheets and, thus, the device is fully functional in the case of multiple sheets, as well, such as double sheets, triple sheets, or the like.

We claim:

1. Adjusting device with a pneumatically operating piston-cylinder unit pressurizable in an operating function thereof for actuating adjusting elements in a printing press, the piston-cylinder unit comprising a cylinder housing formed with a cylinder chamber, a piston displaceable in said cylinder chamber, and an electromagnet for applying an activated holding force to said piston, said piston being subjectible pneumatically to a prepressurizing force in said cylinder chamber opposite to and less than said activated holding force.

2. Adjusting device according to claim 1, wherein said cylinder chamber has an air inlet communicating with an air supply more highly pressurized in a volume greater than that within said cylinder chamber, said air inlet being openable for admitting air with a maximum pressure drop into said cylinder chamber without having to refill any of the air.

3. Adjusting device for arresting travel of a mis-fed sheet in a feeder of a sheet-fed printing press having a pneumatically operational piston-cylinder unit secured to a press frame and being operatively engageable with a control lever for sheet grippers, the piston-cylinder unit comprising a cylinder housing fixed to the press frame and formed with a cylinder chamber, a piston displaceable in an axial direction thereof in said cylinder chamber, and an electromagnet for applying a holding force to said piston, said piston being subjectible pneumatically in said axial direction to a pre-pressurizing force in said cylinder chamber opposite to and less than said holding force.

4. Adjusting device according to claim 3, including a piston rod connected to said piston and having an end extending out of said cylinder housing, an iron armature plate connected to said piston end outside said cylinder chamber, and an electromagnet secured to said cylinder housing opposite said armature plate, said electromagnet and said armature plate, respectively, being formed with mutually parallel contact surfaces.

5. Adjusting device according to claim 4, wherein said iron armature plate is movably disposed in an interior chamber formed in said cylinder housing, said interior chamber having an end face located opposite said piston of the piston-cylinder unit which is formed by said electromagnet.

6. Adjusting device according to claim 3, including a piston rod connected to said piston and having a free end thereof extending out of said cylinder housing, an abutment fixed to said cylinder housing, an adjusting lever swivellable about an axis and spring-biased in a direction of movement thereof against said abutment, said abutment and said adjusting lever being formed with respective support surfaces converging wedgelike towards one another in a direction of operation of said piston, said free end of said piston extending out of said cylinder housing engaging between said support surfaces.

7. Adjusting device according to claim 6, wherein said adjusting lever is a bell crank having one arm whereon the support surface of the adjusting lever is formed, and including at least one roller supported with a roller bearing on said free end of said piston rod outside said cylinder housing, said roller having a peripheral surface with which said roller engages said support surface of said fixed abutment and said support surface on said one arm of said bell crank.

* * * * *